US008595985B1

(12) United States Patent
Feldhaus

(10) Patent No.: US 8,595,985 B1
(45) Date of Patent: Dec. 3, 2013

(54) COVER FOR A RAIN GUTTER

(76) Inventor: Phil Feldhaus, Lake Village, IN (US)

( * ) Notice: Subject to any disclaimer, the term of this patent is extended or adjusted under 35 U.S.C. 154(b) by 0 days.

(21) Appl. No.: 13/495,361

(22) Filed: Jun. 13, 2012

Related U.S. Application Data

(60) Provisional application No. 61/496,193, filed on Jun. 13, 2011.

(51) Int. Cl.
*E04D 13/00* (2006.01)

(52) U.S. Cl.
USPC ..... 52/12

(58) Field of Classification Search
USPC ..... 52/11–16; 248/48.1, 48.2
See application file for complete search history.

(56) References Cited

U.S. PATENT DOCUMENTS

| | | | | |
|---|---|---|---|---|
| 3,295,264 | A * | 1/1967 | Olson | 52/12 |
| 4,907,381 | A | 3/1990 | Ealer | |
| 4,941,299 | A | 7/1990 | Sweers | |
| 4,959,932 | A | 10/1990 | Pfeifer | |
| 5,044,581 | A | 9/1991 | Dressler | |
| 5,056,276 | A * | 10/1991 | Nielsen et al. | 52/12 |
| 5,109,640 | A | 5/1992 | Creson | |
| 5,271,192 | A | 12/1993 | Nothum, Sr. et al. | |
| 5,321,920 | A | 6/1994 | Sichel | |
| 5,406,754 | A * | 4/1995 | Cosby | 52/12 |
| 5,555,680 | A | 9/1996 | Sweers | |
| 5,611,175 | A | 3/1997 | Sweers | |
| 5,848,857 | A | 12/1998 | Killworth et al. | |
| 6,349,506 | B1 | 2/2002 | Pace et al. | |
| 6,463,700 | B2 * | 10/2002 | Davis | 52/12 |
| 6,932,901 | B2 | 8/2005 | Crosby | |
| 6,951,077 | B1 * | 10/2005 | Higginbotham | 52/12 |
| 7,198,714 | B2 | 4/2007 | Switstun | |
| D551,740 | S | 9/2007 | Riley | |
| 7,793,465 | B2 * | 9/2010 | McCann | 52/12 |
| 8,006,438 | B2 * | 8/2011 | Higginbotham | 52/12 |
| RE42,896 | E * | 11/2011 | Higginbotham | 52/12 |
| 2004/0262207 | A1 | 12/2004 | Crosby | |
| 2005/0102909 | A1 | 5/2005 | Carpenter et al. | |
| 2005/0155919 | A1 | 7/2005 | Swistun | |
| 2005/0155920 | A1 | 7/2005 | Swistun | |
| 2006/0053697 | A1 * | 3/2006 | Higginbotham | 52/12 |
| 2006/0070304 | A1 * | 4/2006 | Barnett | 52/11 |
| 2006/0117670 | A1 | 6/2006 | Tsioris | |
| 2006/0163129 | A1 | 7/2006 | Switstun | |
| 2006/0179723 | A1 | 8/2006 | Robins | |
| 2006/0230687 | A1 | 10/2006 | Ealer, Sr. | |
| 2006/0265968 | A1 * | 11/2006 | Lowrie | 52/11 |
| 2008/0289263 | A1 | 11/2008 | Brochu | |
| 2009/0107053 | A1 | 4/2009 | Guilford | |
| 2010/0088971 | A1 * | 4/2010 | Horton | 52/12 |

* cited by examiner

*Primary Examiner* — Mark Wendell
*Assistant Examiner* — Keith Minter
(74) *Attorney, Agent, or Firm* — Patent Law & Venture Group; Gene Scott

(57) ABSTRACT

A cover for a rain gutter is a rigid, rectangular, and planar sheet of expanded metal which has a linear bead of a hydrophobic material engaged within the sheet thickness and protruding away from, and below, the bottom surface of the sheet, the bead further extends in parallel with the long edges of the planar sheet medially over the full sheet length. The sheet may have a screen covering its top surface.

5 Claims, 3 Drawing Sheets

COVER FOR A RAIN GUTTER

This application claims date priority of provisional application U.S. 61/496,193 filed on Jun. 13, 2011 and which is pending at the time of filing of the present application which incorporates by reference said provisional application in its entirety.

BACKGROUND

The present disclosure relates to covers for rain gutters for preventing the accumulation of debris such as leaves, stones, and portions of roofing materials within open rain gutters. Particularly, this disclosure relates to a rain gutter cover having a screening structure and a barrier to water flowing over the screening structure.

A rain gutter is a narrow, long channel, or trough, forming that component of a roof system which collects and diverts rainwater flowing off the roof. Such a gutter may be an integral trough along the lower edge of a roof slope which is fashioned from the roof covering and flashing material, or it may be a metal construct suspended beyond the roof edge and below the projected slope of the roof. It may also be an integral structure beneath the roof edge, traditionally constructed of masonry, fashioned as the crowning element of a wall. The main purpose of a rain gutter is to protect a building's foundation by channeling water away from its base. This may also help to reduce erosion, prevent leaks in basements and crawlspaces, protect painted surfaces by reducing exposure to water, and provide a means to collect rainwater for later use. Rain gutters typically have an open top allowing rain water to enter. A problem with such open rain gutters is that debris may accumulate in them and prevent a desired rate of flow of water to down spouts. It is known to place a screen or mesh metal sheet over open rain gutters to help keep debris from settling thereinto. However, such covers tend to either allow small debris elements through and into the gutter, or tend to allow rain water to flow across them so as to drip from the gutter onto the grounds below the gutter. The presently described apparatus solves this problem as will be clearly described in this writing and shown in the attending drawing figures.

SUMMARY

The presently described apparatus is a cover for a rain gutter and is configured for mounting over the open top of the rain gutter and is mounted thereto or thereabout. The gutter cover may have two or three elements. In the two element embodiment, the gutter cover has an open mesh sheet which forms a relatively horizontal, or slightly tilted away from horizontal, structural surface covering the gutter and it is rigid enough to maintain a generally planar form. A bead of hydrophobic material is laid as a continuous strip on the downwardly facing surface of the mesh sheet in a position parallel with the long edges of the cover and the roof that drains into the gutter. The three element embodiment is constructed in this same manner but additionally has layer of screen material lying over the mesh sheet and may be secured by wrapping the screens edges around edges of the mesh sheet. The gutter cover may be positioned over the gutter and held in place by fastening it to the gutter itself and/or to the roof or other surrounding building structure. One edge of the gutter cover may be pinned under roofing tiles or shingles.

The details of one or more embodiments of these concepts are set forth in the accompanying drawings and the description to follow. Other features, objects, and advantages of these concepts will be apparent from the description and drawings, and from the claims.

DETAILED DESCRIPTION

Figure 1:
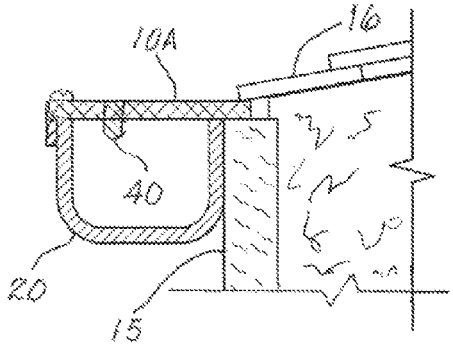
FIG. 1 is an example end sectional view of a rain gutter mounted on a building with a cover of the presently described apparatus topping the rain gutter.
Figure 3:
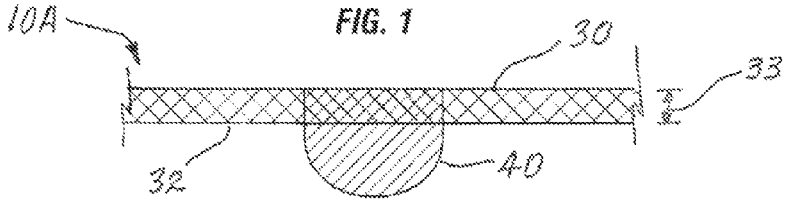
FIG. 3 is an example sectional view taken from FIG. 2 along cutting plane line 3-3.
Figure 2:
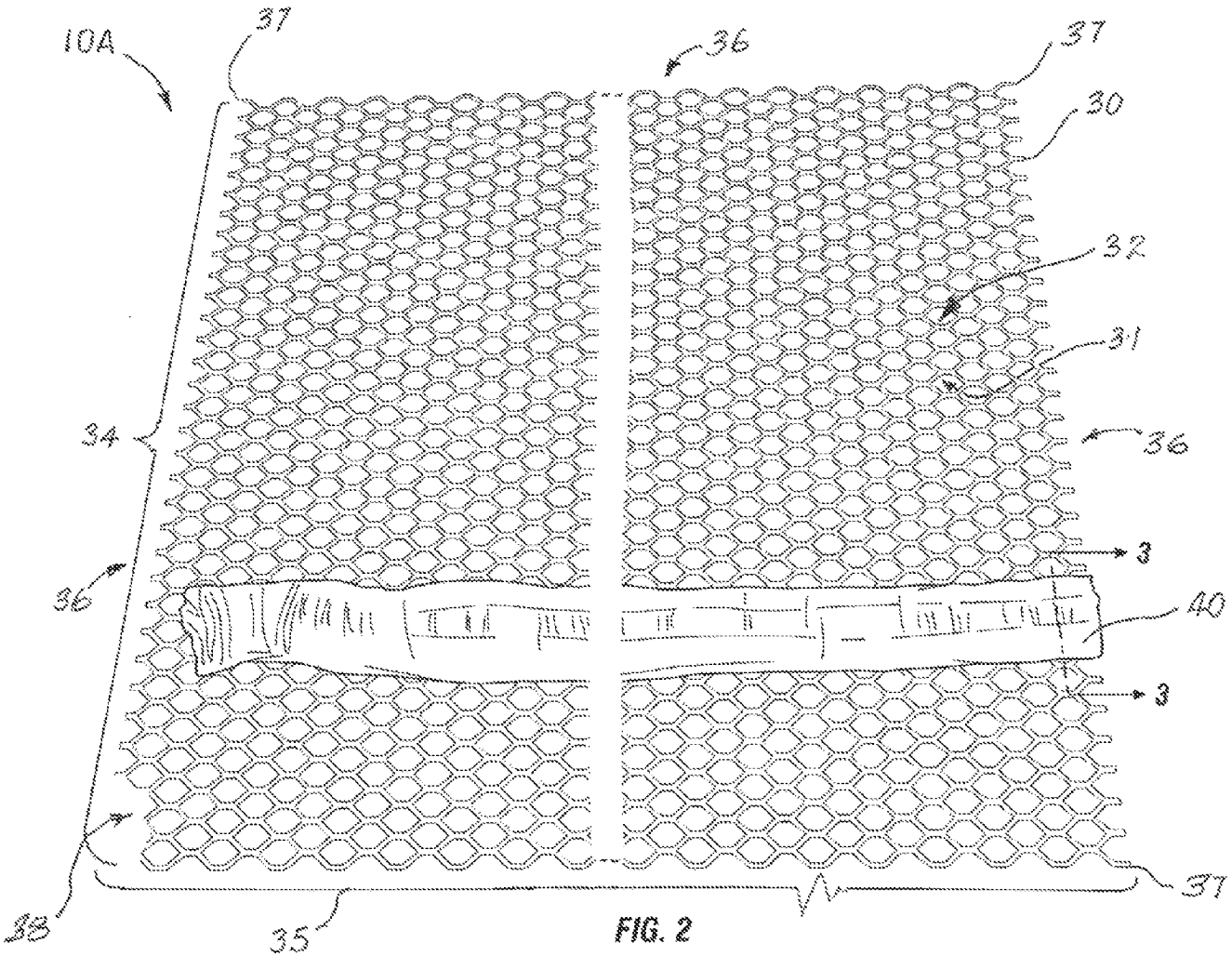
FIG. 2 is an example perspective segmented bottom view of a first embodiment of the cover.
Figure 4:
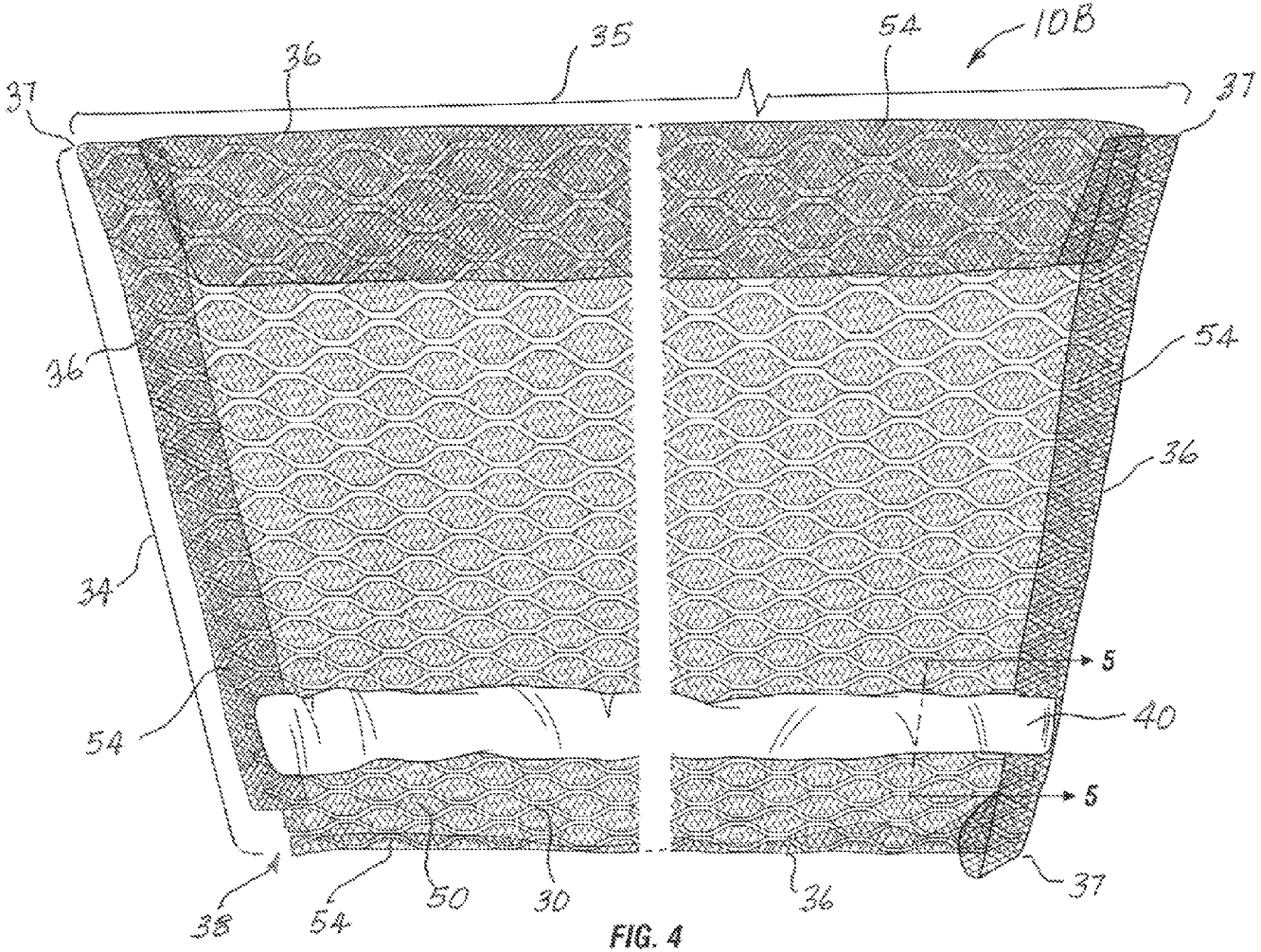
FIG. 4 is an example perspective segmented bottom view of a second embodiment of the cover.

In a first embodiment, a cover 10A for a rain gutter 20 mounted on a building 15 (FIG. 1), is made of a relatively stiff, rectangular, and planar sheet 30 of expanded metal (FIG. 2), the sheet 30 having a top surface 31, a bottom surface 32, a sheet thickness 33 (FIG. 3), a sheet width 34 and a sheet length 35 (FIG. 6), the sheet 30 normally positioned in a near-horizontal attitude but preferably with a downward tilt away from the building on which it is mounted and when engaged with the rain gutter 20. As a rectangular object, sheet 30 has four edges 36 and four corners 37, except that one corner 37 is notched as shown in FIGS. 2 and 4. The openings in the expanded metal sheet 30 may be between about ⅛ and ¼ inches in size. Through extensive testing these openings have been found to be critical in preventing objects from entering the rain gutter 20 while avoiding gutter spill-over. Holes smaller than ⅛ have been found to allow runoff to bridge across the top surface of the sheet 30 to thereby allow a significant amount of water to spill over the gutter 20, and holes larger than ¼ inch have been found to allow an unacceptable amount of debris to enter the gutter 20 through the screen 30.

A linear bead 40 of a hydrophobic material is positioned on the bottom surface 32 of sheet 30 and extends into sheet thickness 33. Bead 40 protrudes away from, and below, the bottom surface 32 of the sheet 30, the bead 40 further extending longitudinally along the sheet 20 in parallel with long edges 36 of the sheet 30 over the length 35 of the sheet 30 and as described below not quite over the full length of the sheet 30. The hydrophobic material may have components including at least one of alkanes, oils, fats, greasy substances, silicones, rubbers, and flurocarbons. Therefore, bead 40 resists water flow over its surface. Water flowing off the building's roof surface 16 will tend to bridge across the openings in the cover 10, and the presence of the bead 40 tends to limit this bridging action.

Figure 5:
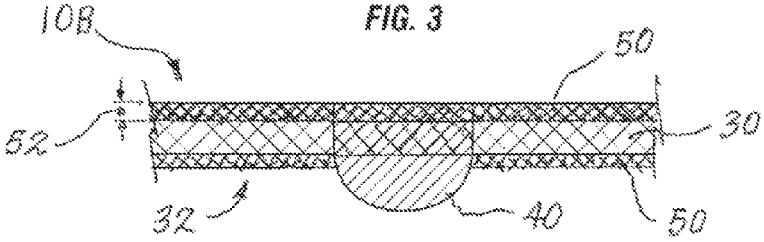
FIG. 5 is an example sectional view taken from FIG. 4 along cutting plane line 5-5.

A second embodiment (FIG. 4), of the cover 10B is similar to cover 10A of the first embodiment described above, but in addition has a screen layer 50 in contact with, and supported by, the sheet 30, the screen layer 50 having a uniform screen thickness 52 (FIG. 5) and is fabricated of a 30 to 40 mesh screening sheet stock. The expanded metal sheet 30 in this second embodiment may have opening in the range of from about ¼ to 7/16 inches. In this second embodiment the bead 40 extends within the both the sheet 30 as well as screen thickness 52 as shown in FIG. 5. The screen layer 50 may be wrapped around the edges 36 of the sheet 30 wherein portions 54 of the screen layer 50 lie adjacent to the bottom surface 32, as shown in FIG. 4, and may be in surface-to-surface contact therewith. One of the portions 54 of the screen layer 50 lying adjacent to the bottom surface 32 may be folded into between 2 and 4 layers in thickness (not shown) in order to provide an improved rigidity. At one or more of the corners 37, the portions 54 of the screen layer 50 that are adjacent to the bottom surface 32 may be overlapped, and this is clearly shown in FIG. 4. Alternately, the wrapped around portions 54 of the screen layer 50 may be mitered (not shown) so that they do not overlap.

When "cover 10" is used in this disclosure, it refers to both the first embodiment cover 10A as well as the second embodiment cover 10B.

It should be understood that sheet length 35 must be limited in order to enable the practical handling and transport of covers 10. Therefore, when adjacent covers 10 must be placed end-to-end in order to fully cover a long rain gutter, the adjacent ends of the two covers 10 are overlapped one over the other. The two covers 10, as seen from ground level, are made to have a uniform and continuous appearance (FIG. 6) by providing a notch 38 at one corner 37 of the overlapped edge 36 into which is positioned a corner 37 of the under-lapped edge 36, which is then fastened to the rain gutter 20.

Sheet 30 may be an expanded metal stock made by shearing a metal sheet in a press, so that the metal stretches, or is stretched, leaving diamond-shaped openings or voids surrounded by interlinked bars of the metal. The most common method of manufacture is to simultaneously slit and stretch the material with one motion. Expanded metal is also referred to as perforated metal and is widely used. Sheet 30 may alternatively be made by an etching process or by weaving metal strands into a rigid fabric as are well known manufacturing techniques. The term "expanded metal" is used herein to refer to any sheet that has openings as shown in the several figures and that is made by any process whatsoever.

Figure 6:
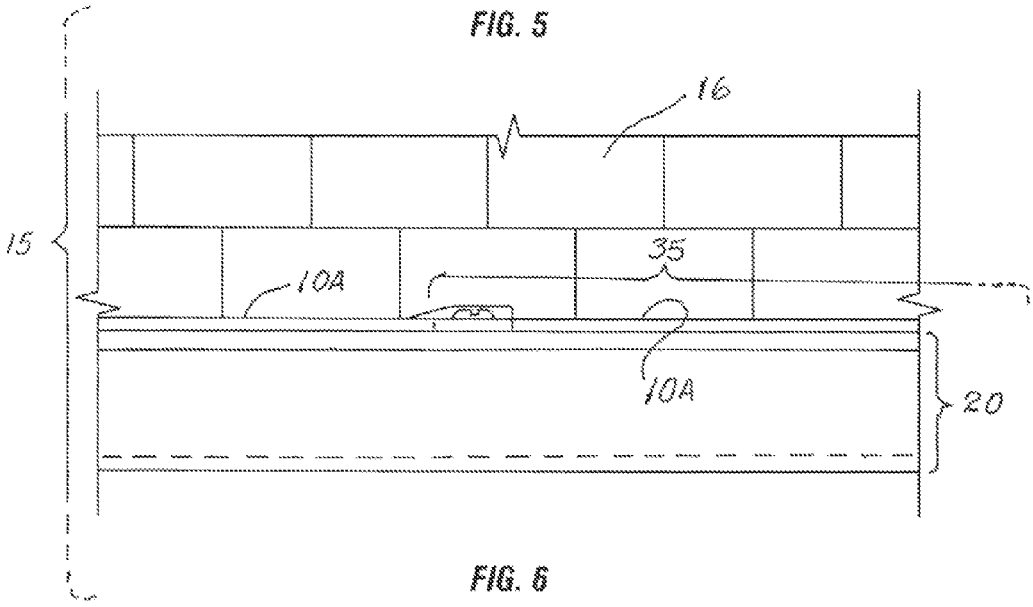
FIG. 6 is an example partial front elevational view of the building with the rain gutter mounted thereon below a roof of the building and showing two overlapping said covers placed on the rain gutter end-too-end with ends overlapping.

No matter the manufacturing method, it is clear that sheet 30 has a thickness as shown which may be in the range of 1/32 to 1/4 inches. Bead 40 extends below the bottom surface of sheet 30 by up to 3/8 inches and also may fully penetrate into sheet 30 up to, and even with its top surface 32. Bead 40 does not extend over or above top surface 32 so that debris cannot be caught on bead 40. Cover 10 may be of any dimensions in width and length. A practical size is approximately five feet in length 35 and wide (width 34) enough to fully cover gutter 20, approximately between 5 and 6 inches. The openings in sheet 30 may be as described above. Such a sheet 30 prevents most objects from passing through and into gutter 20 while enabling water to pass through without significant resistance. Also, the openings are large enough to prevent water from bridging them by surface tension which might enable water to flow across sheet 30. The application of a hydrophobic bead that fully penetrates the sheet 30 and the screen 50 has been found to provide highly superior resistance to water propagation across the cover 10 and is considered to be an important advance in the art. As shown in FIGS. 1 and 6, cover 10 is fastened to rain gutter 20 at the outlying portion of the rain gutter 20 and by common fasteners. The cover 10 may be fastened also under tiles or shingles of the roof or in other ways whereby the cover 10 is assured of securement.

The described structures and their method of use are examples of a concept which may be adapted by those of skill in the art but which will still express the basic understandings defined herein.

What is claimed is:

1. A cover for a rain gutter, the cover comprising:

a planar sheet of expanded metal, the sheet having a top surface, a bottom surface, a sheet thickness, a sheet width, and a sheet length, the sheet normally positioned in a substantially horizontal direction when engaged for covering the rain gutter; and a linear semicircular bead of a hydrophobic material engaged within the sheet thickness and protruding away from, and below, the bottom surface of the sheet, the bead further extending in parallel with an edge of the sheet over the sheet length.

2. The cover for a rain gutter of claim 1 further comprising a screen layer lying on the top surface of the planar sheet with one portion of the screen layer lying adjacent to the bottom surface of the planar sheet the one portion folded into between 2 and 4 layers in thickness.

3. The cover for a rain gutter of claim 1 wherein two portions of the screen layer lying adjacent to the bottom surface are overlapped at a corner of the planar sheet.

4. The cover for a rain gutter of claim 1 wherein a corner common to the sheet and the screen layer is notched.

5. The cover for a rain gutter of claim 1 wherein the hydrophobic material of the linear bead has components including at least one of alkanes, oils, fats, greasy substances, silicones, rubbers, and fluorocarbons.

* * * * *